US006694589B2

(12) United States Patent
Service

(10) Patent No.: US 6,694,589 B2
(45) Date of Patent: Feb. 24, 2004

(54) PROCESS UTILIZING A CLIP FOR THE HANDLING OF A TOW OF FIBERS

(75) Inventor: David Mac Service, Grimsby (GB)

(73) Assignee: Acordis UK Limited, Coventry (GB)

( * ) Notice: Subject to any disclaimer, the term of this patent is extended or adjusted under 35 U.S.C. 154(b) by 0 days.

(21) Appl. No.: 09/943,413

(22) Filed: Aug. 30, 2001

(65) Prior Publication Data

US 2002/0069490 A1 Jun. 13, 2002

(51) Int. Cl.[7] ..... B23P 17/00

(52) U.S. Cl. ..... 29/419.1; 29/423; 24/487; 24/30.5 P

(58) Field of Search ..... 83/14, 913; 29/559, 29/283, 281, 423, 424, 419.1, 436.07; 24/543, 30.5 P, 17 AP, 30.5 R, 487, 559; 132/200, 201, 207, 213, 214, 105, 258, 259, 260, 262, 203; 57/5, 7, 9, 13, 22

(56) References Cited

U.S. PATENT DOCUMENTS

| | | | | | |
|---|---|---|---|---|---|
| 3,670,451 | A | * | 6/1972 | Groves et al. | 446/319 |
| 4,336,022 | A | * | 6/1982 | Lynch et al. | 8/115.54 |
| 4,750,804 | A | * | 6/1988 | Osaka et al. | 385/55 |
| 4,765,129 | A | | 8/1988 | Jodoin et al. | 57/72 |
| 5,039,373 | A | * | 8/1991 | Gilhaus | 156/433 |
| 5,109,878 | A | * | 5/1992 | Kuo-Hua | 132/279 |
| 5,146,532 | A | * | 9/1992 | Hodge | 385/136 |
| 5,226,892 | A | * | 7/1993 | Boswell | 604/180 |
| 5,323,481 | A | * | 6/1994 | Tokumaru et al. | 385/136 |
| 5,348,802 | A | * | 9/1994 | Matsuhisa et al. | 428/367 |
| 5,428,871 | A | * | 7/1995 | Iosif | 24/30.5 R |
| 5,465,742 | A | * | 11/1995 | Dudley | 132/279 |
| 5,535,969 | A | * | 7/1996 | Duffy, Jr. | 248/68.1 |
| 5,609,169 | A | * | 3/1997 | Yang | 132/279 |
| 5,638,836 | A | * | 6/1997 | Yasuda | 132/279 |
| 5,709,138 | A | * | 1/1998 | Rimer | 83/18 |
| 5,960,522 | A | * | 10/1999 | Boe | 24/543 |
| 5,966,492 | A | * | 10/1999 | Bechamps et al. | 385/135 |
| 5,996,593 | A | * | 12/1999 | Horman | 132/278 |

FOREIGN PATENT DOCUMENTS

| | | |
|---|---|---|
| DE | 31 41 336 A | 6/1983 |
| FR | 1 544 843 A | 11/1968 |
| FR | 2 550 587 A | 2/1985 |
| GB | 1188625 | 4/1970 |
| GB | 1224535 | 3/1971 |
| GB | 2 252 352 a | 8/1992 |

* cited by examiner

*Primary Examiner*—Robert J. Sandy
*Assistant Examiner*—Dinesh Melwani
(74) *Attorney, Agent, or Firm*—Howson and Howson

(57) ABSTRACT

A process for the handling of a tow of fibres during manufacture and subsequent processing prior to splicing is described. The process includes the step of applying a clip to the free end of the tow, prior to transport of the tow. The fibre is preferably a carbon fibre precursor, and the clip is preferably removed and the tow spliced prior to the steps of oxidation and carbonization to form the carbon fibre.

9 Claims, 3 Drawing Sheets

PROCESS UTILIZING A CLIP FOR THE HANDLING OF A TOW OF FIBERS

BACKGROUND OF THE INVENTION

The present invention relates to an improved process for the handling of fibers during manufacture and subsequent processing and to an improved clip, which clip is particularly suitable for use in the improved process.

It is known in the manufacture of fibers for the manufacturer of the fibers to supply fibers for further processing to their customers in cans or cartons. When the carton or can is full of fiber, the tow or bundle of fibers is cut and the ends are tied in a knot to stop the tow fraying. In use and before further processing, it is generally necessary for the customer to splice the new tow of fiber to a tow currently in use. Because of the knotting of the end of the new tow, the customers have to discard the first 2 to 3 meters of fiber before they have a section suitable for splicing. The discarding of a length of tow each time a new tow is used is clearly undesirable.

It is a particular requirement in the manufacture and subsequent processing of acrylic fiber that the tow of fibers is presented in a form having a rectangular cross-section. The processing of acrylic fiber includes the steps of oxidation and carbonisation, during which process steps the tow is processed at high temperature in a furnace. If the tow frays or does not have a regular rectangular cross-section then any fibers or fiber ends which protrude from the surface of the tow are burnt off in the furnace and the fiber tow is damaged. In the conventional process described above, in which the end of the tow is knotted, it is particularly important to cut off and discard a sufficient length of fiber so that the cut end presents a rectangular cross-section.

It is also known to provide clips for, in particular, the temporary sealing or closing of flexible containers, for example storage bags used in domestic freezers. These clips comprise two substantially straight portions joined at one end by a simple hinge. The free ends of the two substantially straight portions together form a simple hook and clasp mechanism. The two substantially straight portions are profiled in cross-section to provide an array of engaging grooves and ribs which co-operate on closing of the clip over the opening of a flexible container to substantially seal the container and retain any contents therein. Known clips are generally made of plastics material and vary in cross section and length, depending on the size of container with which they are intended to be used.

It is an object of the present invention to provide a novel process for the handling of fibers during manufacture and subsequent processing in which the above disadvantages are reduced or substantially obviated.

It is a further object of the present invention to provide a novel means for preventing fraying of the end of a tow of fibers in which the above disadvantages are reduced or substantially obviated.

BRIEF SUMMARY OF THE INVENTION

The present invention provides a process for the handling of a tow of fibers during manufacture and subsequent processing prior to splicing characterised in that said process includes the step of applying a clip to the free end of said tow, prior to transport of said tow. In a preferred embodiment of the process according to the invention, two clips are applied to the end of said tow, the first close to said free end of said tow and the second spaced along the length of said tow, preferably between 20 and 40 cm from said first clip, more preferably approximately 30 cm from said first clip.

The process according to the invention is of particular application in the handling of carbon fiber precursors, for example acrylic fibers, prior to oxidation and carbonisation to form the carbon fiber.

The present invention further provides a clip for holding an end of a tow of fibers, which clip comprises two substantially straight portions joined at one end by a hinge, the free ends of said two substantially straight portions together forming a clasp mechanism characterised in that the inner surfaces of said two substantially straight portions are flat and smooth along at least part of the length thereof and in that spacing means are provided on said inner surface of at least one of said substantially straight portions of said clip, such that when said clip is closed, said two substantially straight portions are spaced one from the other by a predetermined amount.

In a preferred embodiment of a clip according to the invention, said inner surfaces of said two substantially straight portions are flat and smooth along at least the major part of the length thereof.

In a further preferred embodiment of a clip according to the invention, said spacing means comprise two pairs of projecting pins provided on said inner surface of one of said substantially straight portions of said clip, the first pair being arranged close to said hinge and the second pair being arranged close to said free end of said substantially straight portion.

BRIEF DESCRIPTION OF THE DRAWINGS

An embodiment of a clip for holding an end of a tow of fibers will now be further described with reference to the accompanying drawings, in which.

DETAILED DESCRIPTION

Figure 1:
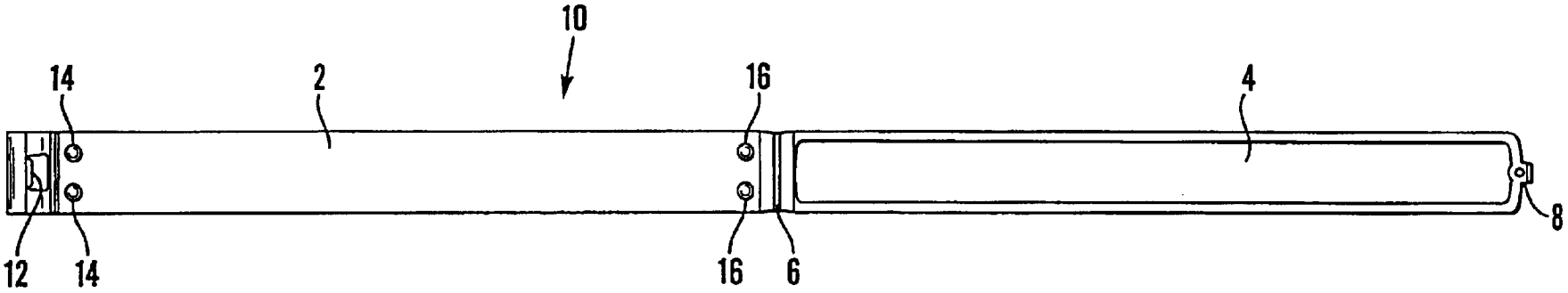
FIG. 1 is a plan view of a clip in the open position.
Figure 2:
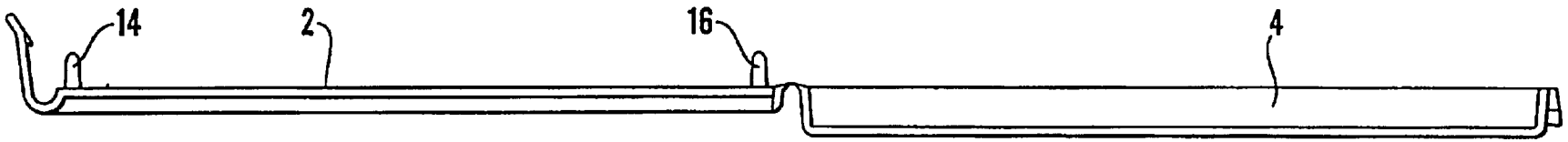
FIG. 2 is a side view of the clip of FIG. 1.

A clip shown generally at 10 comprises a first substantially straight portion 2 and a second substantially straight portion 4. Portions 2 and 4 are connected by a hinge 6 which is integral with the portions 2 and 4. The portion 4 terminates at its free end in a hook portion 8. The portion 2 terminates at its free end in a clasp portion 12. The hook portion 8 is adapted to engage with the clasp portion 12 when the clip 10 is in the closed position.

A first pair of pins 14 project from the inner surface of the clip portion 2, close to the clasp portion 12. A second pair of pins 16 project from the inner surface of the clip portion 2, close to the hinge 6. The inner surface of the clip portion 2 between the first pair of pins 14 and the second pair of pins 16 is flat and smooth, as is the inner surface of the clip portion 4 between the hook portion 8 and clasp portion 12.

Figure 3:
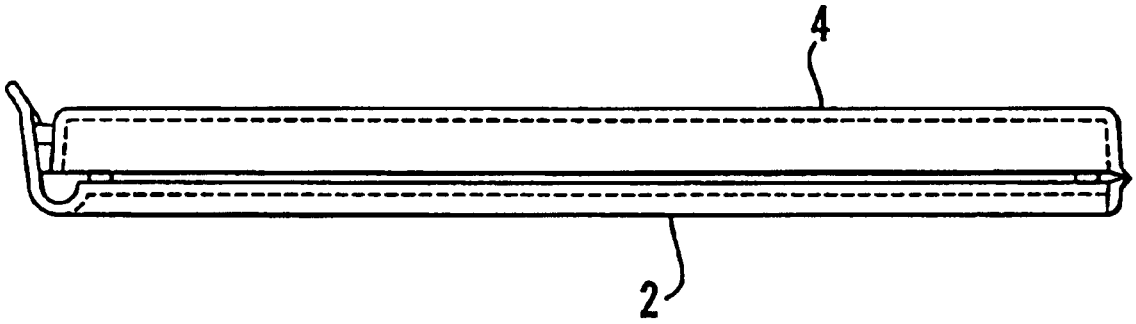
FIG. 3 is a side view of the clip of FIG. 1 in the closed position.
Figure 4:
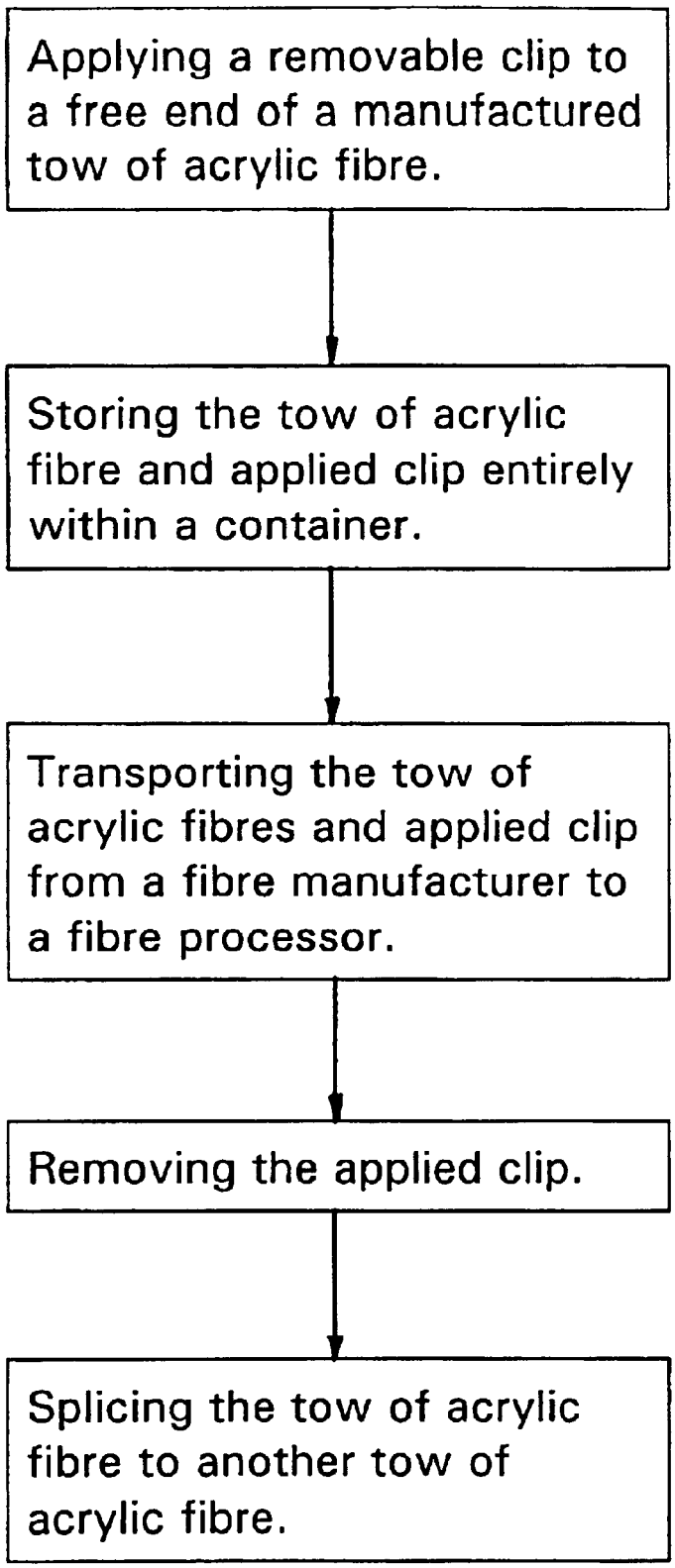
FIG. 4 is a flowchart showing the steps of one embodiment of a method according to the present invention.

As can be seen from FIG. 3, when the clip is in the closed position as shown in this Figure, the inner surfaces of the clip portions 2 and 4, together with the two pairs of pins 14 and 16, together define a space 18 for receipt of the tow of fiber. A tow of fibers is stored in a container. A pair of clips 10 can be applied to the tow of fibers.

The clips according to the invention may be of any suitable size, but a particularly useful length of clip has been found to be 170 mm, measuring between the pairs of pins, with a pin height of 8 mm.

The clip may be made of any suitable material and synthetic plastics materials such as polypropylene have been found to be particularly suitable.

What is claimed is:

1. A process for the handling and subsequent processing of a manufactured tow of acrylic fiber, comprising the steps of:

applying a removable clip to a free end of a manufactured tow of acrylic fiber;

storing said tow of acrylic fiber and applied clip entirely within a container;

transporting said tow of acrylic fiber and applied clip in said container from a fiber manufacturer to a fiber processor, said clip preventing fraying of said free end during transport; and after said transporting step, removing said applied clip and splicing said tow of acrylic fiber to another tow of acrylic fiber.

2. A process according to claim 1, wherein said tow is presented in a form having a rectangular cross-section.

3. A process according to claim 2, wherein said clip has two substantially straight portions joined at one end by a hinge; wherein said two substantially straight portions have free ends that form a clasp mechanism and have inner surfaces that are flat and smooth along at least the major part of a length thereof; and wherein spacing means is provided on said inner surface of one of said substantially straight portions of said clip, such that, when said clip is closed, said two substantially straight portions are spaced one from the other by a predetermined amount.

4. A process according to claim 3, wherein said spacing means includes first and second pairs of projecting pins provided on said inner surface of one of said substantially straight portions of said clip, said first pair being arranged close to said hinge and said second pair being arranged close to said free end of said substantially straight portion.

5. A process according to claim 1, wherein said process further includes the step of cutting the end of said tow of fiber adjacent to said clip.

6. A process according to claim 1, further comprising the step of oxidizing and carbonizing said acrylic fiber to form carbon fiber after said clip is removed and said tow spliced.

7. A process according to claim 1, wherein two clips are applied to the end of said tow, the first close to the free end of said tow and the second spaced along the length of said tow.

8. A process according claim 7 wherein said second clip is spaced from said first clip by between 20 and 40 cm.

9. A process according to claim 6 wherein said second clip is spaced from said first clip by approximately 30 cm.

* * * * *